US011521455B2

(12) United States Patent
Gupta

(10) Patent No.: US 11,521,455 B2
(45) **Date of Patent: *Dec. 6, 2022**

(54) METHOD OF HOLDING SPECIAL SYMBOLS IN A FEATURE GAME PLAYED ON A GAMING SYSTEM

(71) Applicant: Aristocrat Technologies Australia Pty Limited, North Ryde (AU)

(72) Inventor: Lipi Gupta, Newington (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 29 days.

This patent is subject to a terminal disclaimer.

(21) Appl. No.: 17/131,183

(22) Filed: Dec. 22, 2020

(65) Prior Publication Data

US 2021/0110641 A1 Apr. 15, 2021

Related U.S. Application Data

(63) Continuation of application No. 15/905,016, filed on Feb. 26, 2018, now Pat. No. 10,909,799.

(30) Foreign Application Priority Data

Feb. 27, 2017 (AU) ..... 2017201335

(51) Int. Cl.
*G07F 17/32* (2006.01)
*G07F 17/34* (2006.01)

(52) U.S. Cl.
CPC ..... *G07F 17/3213* (2013.01); *G07F 17/3262* (2013.01); *G07F 17/3265* (2013.01); *G07F 17/34* (2013.01)

(58) Field of Classification Search
None
See application file for complete search history.

(56) References Cited

U.S. PATENT DOCUMENTS 8,651,940 B2 * 2/2014 Loat ..... G07F 17/3265 463/16
9,017,160 B2 * 4/2015 Moroney ..... G07F 17/34 463/20

(Continued)

OTHER PUBLICATIONS

Office Action dated Jun. 25, 2020 for U.S. Appl. No. 15/905,016 (pp. 1-9).

(Continued)

*Primary Examiner* — James S. McClellan
*Assistant Examiner* — Peter J Iannuzzi
(74) *Attorney, Agent, or Firm* — McAndrews, Held & Malloy, Ltd.

(57) ABSTRACT

A gaming system is disclosed that comprises a symbol selector configured to select a plurality of symbols from a set of symbols for display in a respective plurality of display positions in a display area, the set of symbols including a plurality of defined special symbols, and a special symbol determiner configured to determine whether at least two special symbols are displayed adjacent each other. The gaming system is configured to hold special symbols determined to be displayed adjacent each other at respective display positions for at least one subsequent selection of symbols. The gaming system further comprises an outcome evaluator configured to determine a game outcome based on the displayed symbols including the displayed held special symbols.

20 Claims, 9 Drawing Sheets

(56) References Cited

U.S. PATENT DOCUMENTS

| | | | | |
|---|---|---|---|---|
| 10,037,651 | B2 * | 7/2018 | You | G07F 17/3267 |
| 10,909,799 | B2 * | 2/2021 | Gupta | G07F 17/3265 |
| 2010/0210343 | A1 * | 8/2010 | Englman | G07F 17/32<br>463/43 |
| 2010/0298041 | A1 * | 11/2010 | Berman | G07F 17/3213<br>463/20 |
| 2012/0258785 | A1 * | 10/2012 | Suda | G07F 17/3267<br>463/31 |
| 2014/0302908 | A1 * | 10/2014 | Walker | G07F 17/3265<br>463/20 |
| 2018/0130298 | A1 * | 5/2018 | Koshorek | G07F 17/3213 |

OTHER PUBLICATIONS

Notice of Allowance dated Nov. 3, 2020 for U.S. Appl. No. 15/905,016 (pp. 1-7).

* cited by examiner

METHOD OF HOLDING SPECIAL SYMBOLS IN A FEATURE GAME PLAYED ON A GAMING SYSTEM

RELATED APPLICATION(S)

The present application is a continuation of U.S. patent application Ser. No. 15/905,016, filed Feb. 26, 2018, and claims priority to Australian Patent Application No. 2017201335, filed Feb. 27, 2017, and entitled "A Gaming System and a Method of Gaming" which is hereby incorporated by reference.

FIELD

The present invention relates to a gaming system and to a method of gaming.

BACKGROUND

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

SUMMARY

In accordance with a first aspect of the present invention, there is provided a gaming system comprising:

a symbol selector arranged to select a plurality of symbols from a set of symbols for display in a respective plurality of display positions in a display area, the set of symbols including a plurality of defined special symbols; and a special symbol determiner arranged to determine whether at least two special symbols are displayed adjacent each other;

the gaming system arranged to hold special symbols determined to be displayed adjacent each other at respective display positions for at least one subsequent selection of symbols; and the gaming system further comprising an outcome evaluator arranged to determine a game outcome based on the displayed symbols including the displayed held special symbols.

In an embodiment, the special symbol determiner is arranged to determine that two special symbols are displayed adjacent each other if the two special symbols are displayed vertically adjacent each other.

In an embodiment, the special symbol determiner is arranged to determine that two special symbols are displayed adjacent each other if the two special symbols are displayed laterally adjacent each other.

In an embodiment, the special symbol determiner is arranged to determine that two special symbols are displayed adjacent each other if the two special symbols are displayed diagonally adjacent each other.

In an embodiment, the displayed symbols are associated with a plurality of display position groups, each display position group including a plurality of display positions and each display position group including a plurality of associated selectable symbols.

In an embodiment, each display position is associated with a different sub-set of selectable symbols.

In an embodiment, a plurality of different symbols are defined as special symbols.

In an alternative embodiment, one symbol type is defined as a special symbol.

In an embodiment, if at least two special symbols are disposed adjacent each other at two different locations in the display area to define two different special symbol clusters, the system may be arranged to make a determination as to whether to hold one or more of the special symbol clusters and, if so, which of the special symbol clusters to hold.

In an embodiment, the gaming system is arranged to hold the special symbol cluster that forms the largest or smallest cluster.

In an embodiment, the gaming system is arranged to randomly select a special symbol cluster and to hold the selected special symbol cluster.

In an embodiment, the system may be arranged such that when a special symbol cluster reaches a defined size, the held symbols are released so that no special symbols are held for a subsequent selection of symbols.

In an embodiment, the outcome evaluator is arranged to determine game outcomes in accordance with defined win lines such that winning outcomes are determined to exist when defined symbols appear along defined win lines.

In an embodiment, the defined win lines are determined based on all win lines that pass through a selected display position group, each display position group including a plurality of display positions, and that meet defined win line criteria outside of the selected display position group. The gaming system may be arranged to facilitate selection of the selected display position group by a user.

In an embodiment, the defined win lines correspond to a default win line that passes across all display position groups and win lines that correspond to the default win line outside of the selected display position group and all combinations that pass through the selected display position group.

In one embodiment, the gaming system is arranged to operate in normal game mode and special game mode, and the gaming system is arranged to:

determine whether at least two special symbols are displayed adjacent each other, and hold special symbols determined to be displayed adjacent each other at respective display positions for at least one subsequent selection of symbols only when the gaming system operates in special game mode.

The gaming system may be arranged to commence special game mode when a predetermined game outcome occurs, on the basis of a game event occurring during a game such as display of a particular symbol, in response to player input, based on the amount or type of bet placed, or when a special game is purchased by a player.

The gaming system may be implemented as a stand alone gaming machine or across a network.

In accordance with a second aspect of the present invention, there is provided a method of gaming comprising:

selecting a plurality of symbols from a set of symbols for display in a respective plurality of display positions in a display area, the set of symbols including a plurality of defined special symbols; and determining whether at least two special symbols are displayed adjacent each other;

holding special symbols determined to be displayed adjacent each other at respective display positions for at least one subsequent selection of symbols; and determining a game outcome based on the displayed symbols including the displayed held special symbols.

In accordance with a third aspect of the present invention, there is provided a computer program arranged when loaded into a computer to instruct the computer to operate in accordance with a gaming system according to the first aspect of the present invention.

In accordance with a fourth aspect of the present invention, there is provided a computer readable medium having computer readable program code embodied therein for causing a computer to operate in accordance with a gaming system according to the first aspect of the present invention.

In accordance with a fifth aspect of the present invention, there is provided a data signal having computer readable program code embodied therein for causing a computer to operate in accordance with a gaming system according to the first aspect of the present invention.

BRIEF DESCRIPTION OF THE DRAWINGS

The present invention will now be described, by way of example only, with reference to the accompanying drawings, in which.

DETAILED DESCRIPTION

Figure 1:
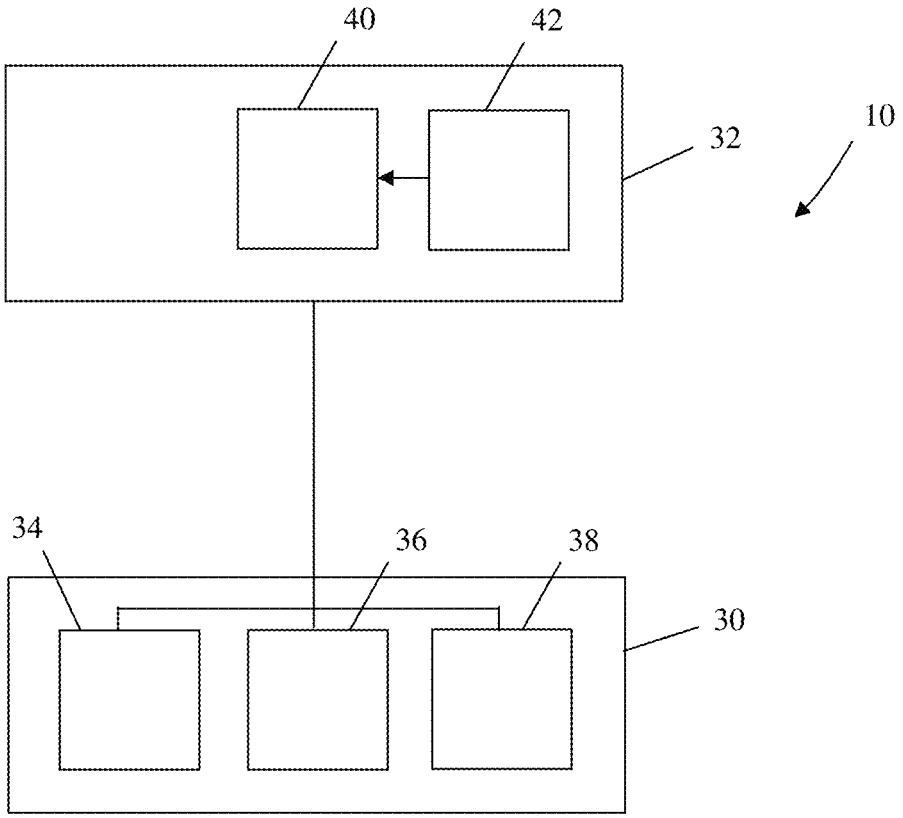
FIG. 1 is a schematic block diagram of core components of a gaming system in accordance with an embodiment of the present invention.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that at least during a portion of a game implemented by the gaming system, the gaming system is arranged to define one or more special symbols and to hold special symbols in the respective display positions for at least one subsequent selection of symbols if two or more special symbols are displayed adjacent each other. In this way, it is possible to progressively increase the number of adjacently displayed special symbols by implementing several consecutive feature games, with the likelihood of a win outcome occurring increasing as the number of displayed special symbols increases. In an example, the special symbol may be a defined symbol or a WILD symbol.

It will be understood that a special symbol may be considered to be adjacent another special symbol if the special symbol is disposed laterally adjacent the other special symbol, directly above or below the other special symbol, diagonally adjacent the other special symbol, or any combination of these.

Referring to FIG. 1, a schematic diagram of core components of a gaming system 10 is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
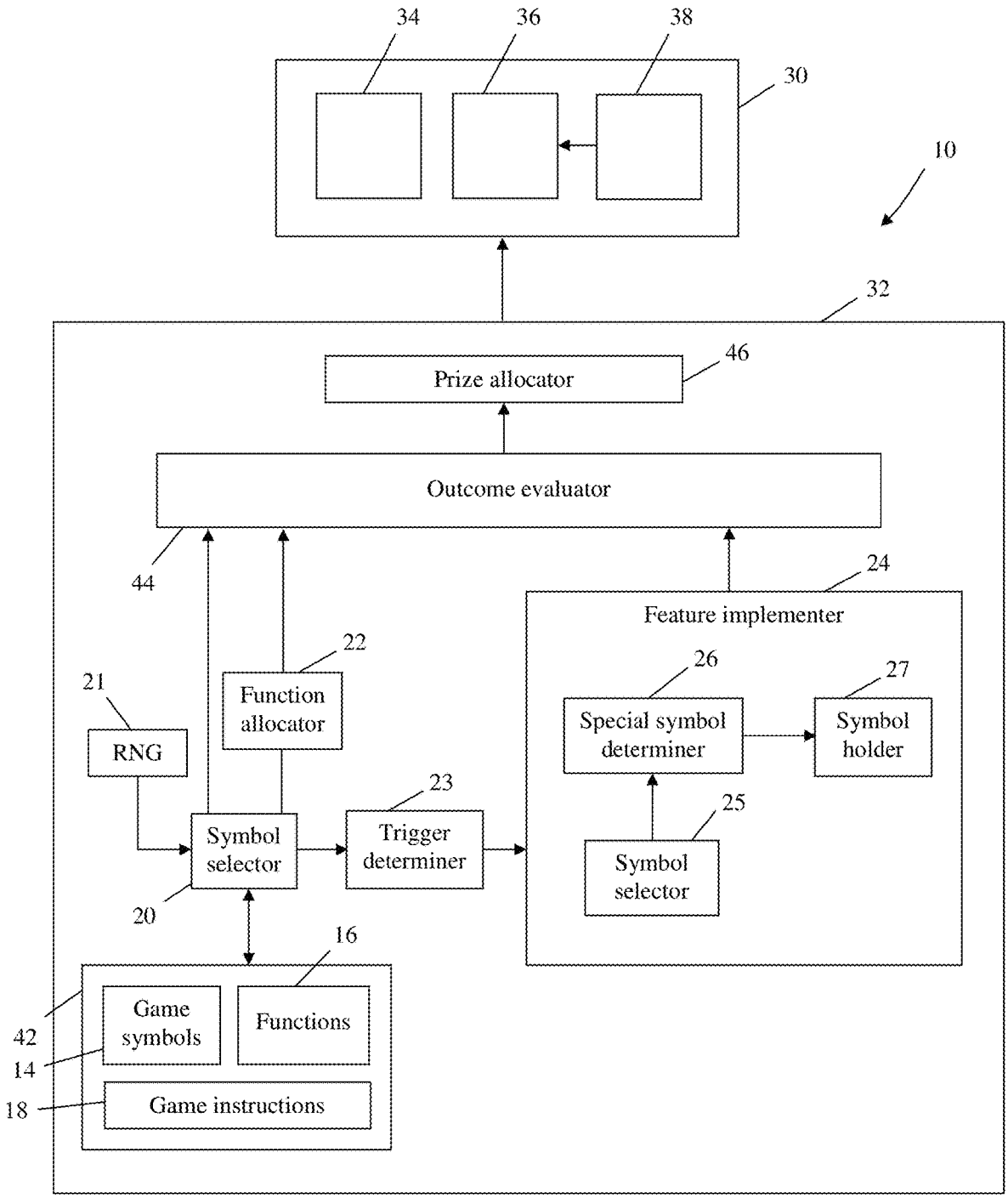
FIG. 2 is a schematic block diagram of functional components of a gaming system in accordance with an embodiment of the present invention.

A functional diagram illustrating operative components of the game controller 32 is shown in FIG. 2.

In this example, the game controller 32 is arranged to implement a base game and a feature game in response to a trigger condition occurring during a base game, with the base game being of conventional implementation and the feature game implemented in accordance with the present invention, although it will be understood that other arrangements are possible.

The memory 42 is arranged to store symbols data 14 indicative of a plurality of symbols for subsequent display to a player, function data 16 indicative of one or more functions allocatable to the symbols, and game instruction data 18 indicative of game instructions usable by the gaming machine 10 to control operation of the game.

The game controller 32 includes a symbol selector 20 which is arranged to select several symbols from the game symbols 14 for display to a player. In this example, the selection carried out by the symbol selector 20 is made using a random number generator 21.

It will be appreciated that the random number generator 21 may be of a type which is arranged to generate pseudo random numbers based on a seed number, and that in this specification the term "random" will be understood accordingly to mean truly random or pseudo random.

In this example, the game controller 32 also comprises a function allocator 22 arranged to select and allocate one or more functions to one or more symbols. Such functions include a wild function, a scatter function, or any other function which may be applied to a symbol or to the game.

The game controller 32 also comprises a trigger determiner 23 arranged to determine whether a trigger condition has occurred during a base game and to instigate a feature game in response to the trigger condition.

The game controller 32 also comprises a feature implementer 24 that includes a symbol selector 25 arranged to select several symbols from the game symbols 14 for display to a player during the feature game. In this example, the selection carried out by the symbol selector 25 is made using the random number generator 21. The symbol selector 25 may be different to or the same as the symbol selector 20.

The feature implementer 24 also comprises a special symbol determiner 26 arranged to determine whether a special symbol has been selected for display by the symbol selector 25 and whether each displayed special symbol is displayed adjacent another special symbol. In response to the determination that a special symbol is displayed adjacent another special symbol, a symbol holder 27 causes the determined adjacently disposed special symbols to be held in their respective display positions for at least one subsequent selection of symbols.

The game controller 32 also comprises an outcome evaluator 44 which in accordance with the game instructions 18 determines game outcomes based on the symbols selected for display to a player by the symbol selector 20 during a base game and during a feature game. Also included is a prize allocator 46 arranged to allocate prizes to a player that correspond to winning outcomes determined by the outcome evaluator 44.

In the embodiments described below, the symbol selector 20, the function allocator 22, the trigger determiner 23, the feature game implementer 24, the special symbol determiner 25, the symbol holder 27, the outcome evaluator 44 and the prize allocator 46 are at least partly implemented using the processor 40 and associated software, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
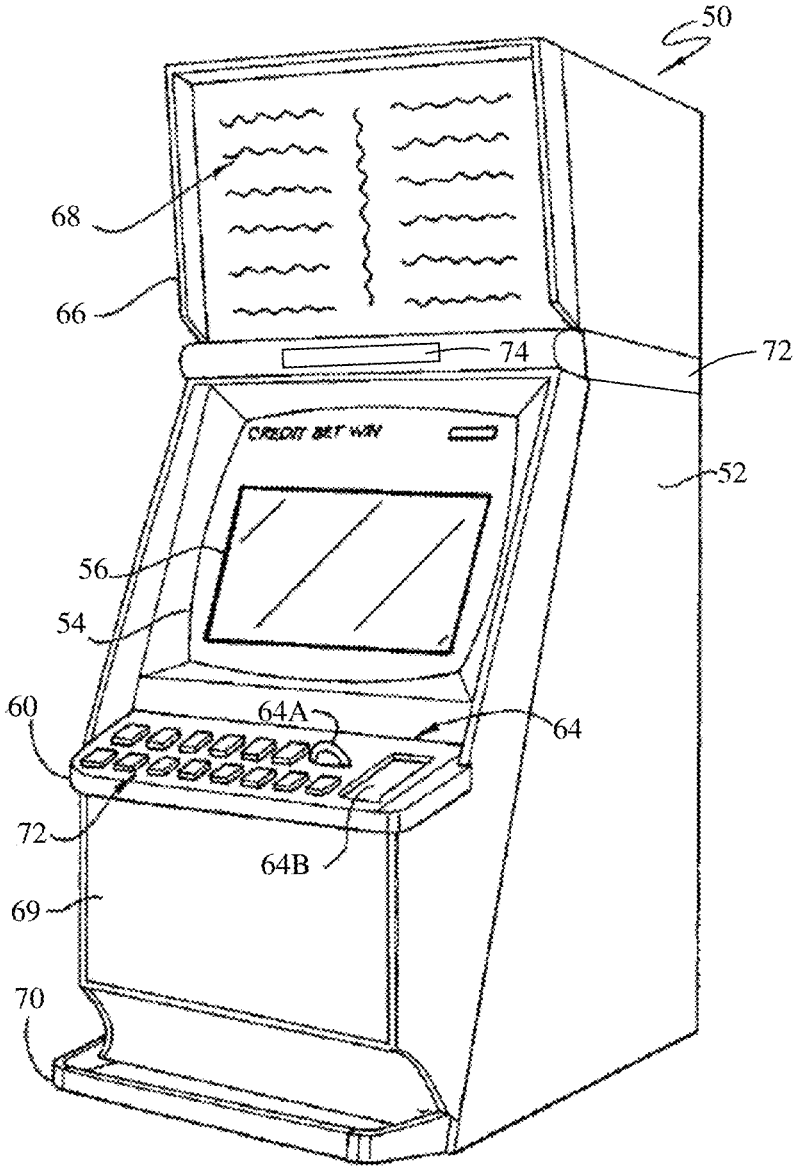
FIG. 3 is a diagrammatic representation of a gaming system in accordance with an embodiment of the present invention with the gaming system implemented in the form of a stand alone gaming machine.

A gaming system in the form of a stand alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 72 for enabling a player to interact with the gaming machine, in particular during game play. The mid-trim 60 also houses a credit input mechanism 64 which in this example includes a coin input chute 64A and a bill collector 64B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type.

The display 54 in this example is arranged to display representations of several reels, each reel of which has several associated symbols. Typically 3, 4 or 5 reels are provided. During operation of a game, the reels first appear to rotate then stop with typically three symbols visible on each reel. Game outcomes are determined on the basis of the visible symbols together with any special functions associated with the symbols, and if a function has been allocated to a reel, on the basis of the allocated function.

Figure 4:
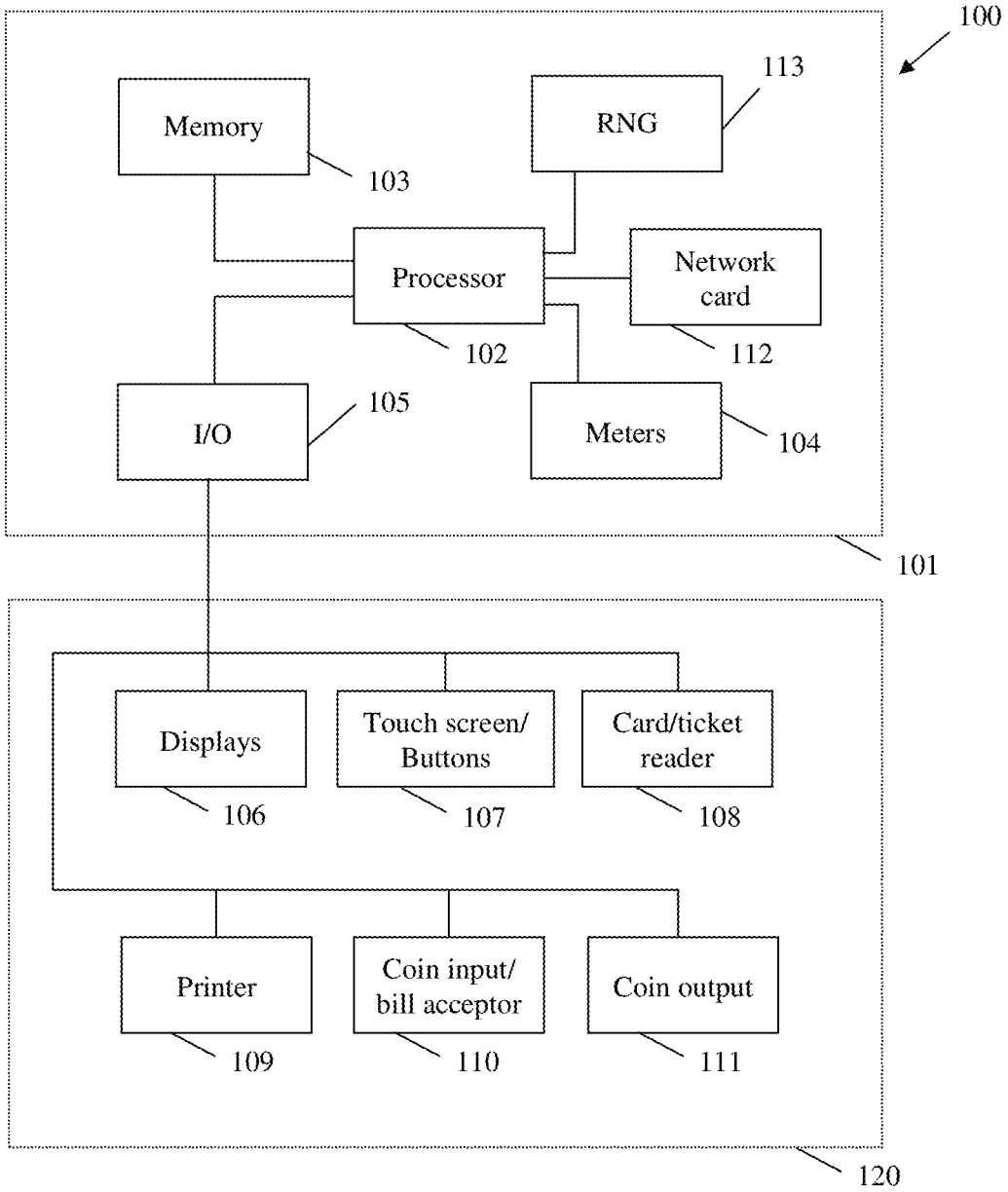
FIG. 4 is a schematic block diagram of operative components of the gaming machine shown in FIG. 3.

FIG. 4 shows a block diagram of operative components of a typical gaming machine 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
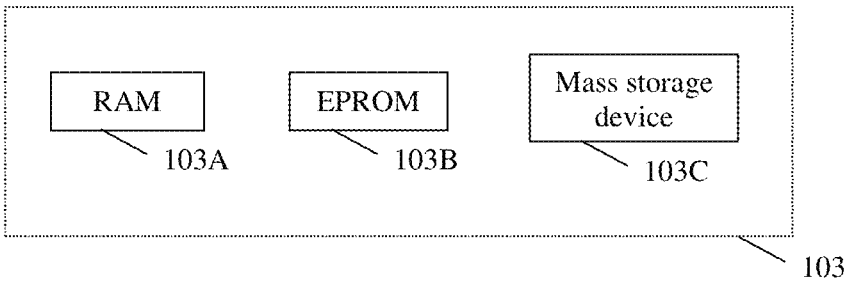
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
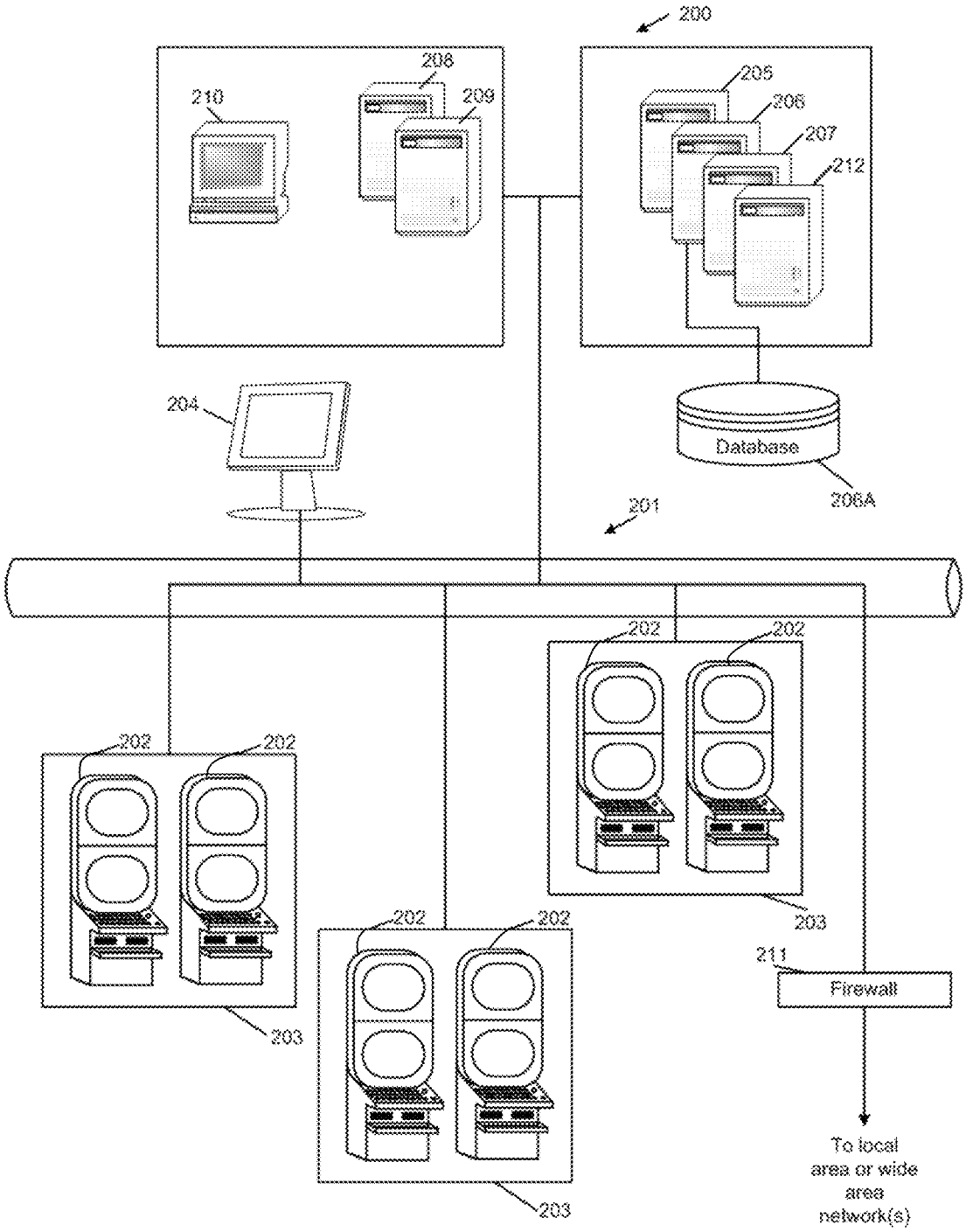
FIG. 6 is a schematic diagram of a gaming system in accordance with an alternative embodiment of the present invention with the gaming system implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40, 100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 44, 100 or over a network 201, implements a probabilistic game wherein at least during part of the game the gaming system is arranged to define one or more special symbols, and hold special symbols in their respective display positions for at least one subsequent selection of symbols if two or more special symbols are displayed adjacent each other. In this way, 'clusters' of special symbols are produced that are retained for at least one feature game and can increase in size over a series of feature games.

Examples of specific implementations of the gaming system will now be described in relation to a stand alone gaming machine 10, 44, 100 although it will be understood that implementation may also be carried out using other gaming system architectures such as a network architecture of the type shown in FIG. 6.

In the present example, the gaming system is operable in normal game mode and special game mode.

During normal game mode, a base game is implemented wherein reels comprising standard symbols and optionally one or more function symbols are provided. Win outcomes are determined on the basis of the symbols visible when the reels stop rotating, and in this example five reels are provided with three symbols visible on each reel at any time. A win outcome may occur based on display of the same symbol along a horizontal or diagonal line, as scattered symbols, or in any other predefined way. A win outcome may also occur on the basis of one or more standard symbols in combination with at least one function symbol having a predetermined assigned function. For example a function symbol may correspond to a wild function, a scatter function, a multiply function, a repeat win function, and so on.

During special game mode, a feature game is implemented by the feature implementer 24 wherein one or more special symbols are defined and the special symbols are held in their respective display positions for at least one subsequent selection of symbols if two or more special symbols are displayed adjacent each other.

In the present example, game outcomes are determined in accordance with defined win lines such that winning outcomes are determined to exist when defined symbols appear along defined win lines. The defined win lines may be determined, at least in part, by selecting, for example by a user, one or more columns of a display area and defining the win lines as all win lines that pass through the selected column and that meet defined win line criteria outside of the selected column. For example, a default win line that passes centrally across all display positions may be provided and additional win lines added by selecting one or more columns, with the additional win lines corresponding to the default win line outside of the selected column(s) and all combinations that pass through the selected columns(s).

The gaming system may be arranged to commence special game mode when a predetermined game outcome occurs during a base game, and special game mode may comprise one or more free games. Special game mode may commence automatically on the basis of a game event occurring during a game such as display of one or more particular symbols, based on game outcomes determined by the gaming system, or may be prompted by a player pressing a button on the gaming system 10, 44, 100 after the player has identified that a game outcome corresponding to special game mode requirements has occurred.

The gaming system 10, 44, 100 may also be arranged so as to determine eligibility for special game mode, for example based on the amount or type of bet placed, based on certain time periods and so on.

Special game mode may also be arranged to commence when a special game is purchased by a player.

Figure 7:
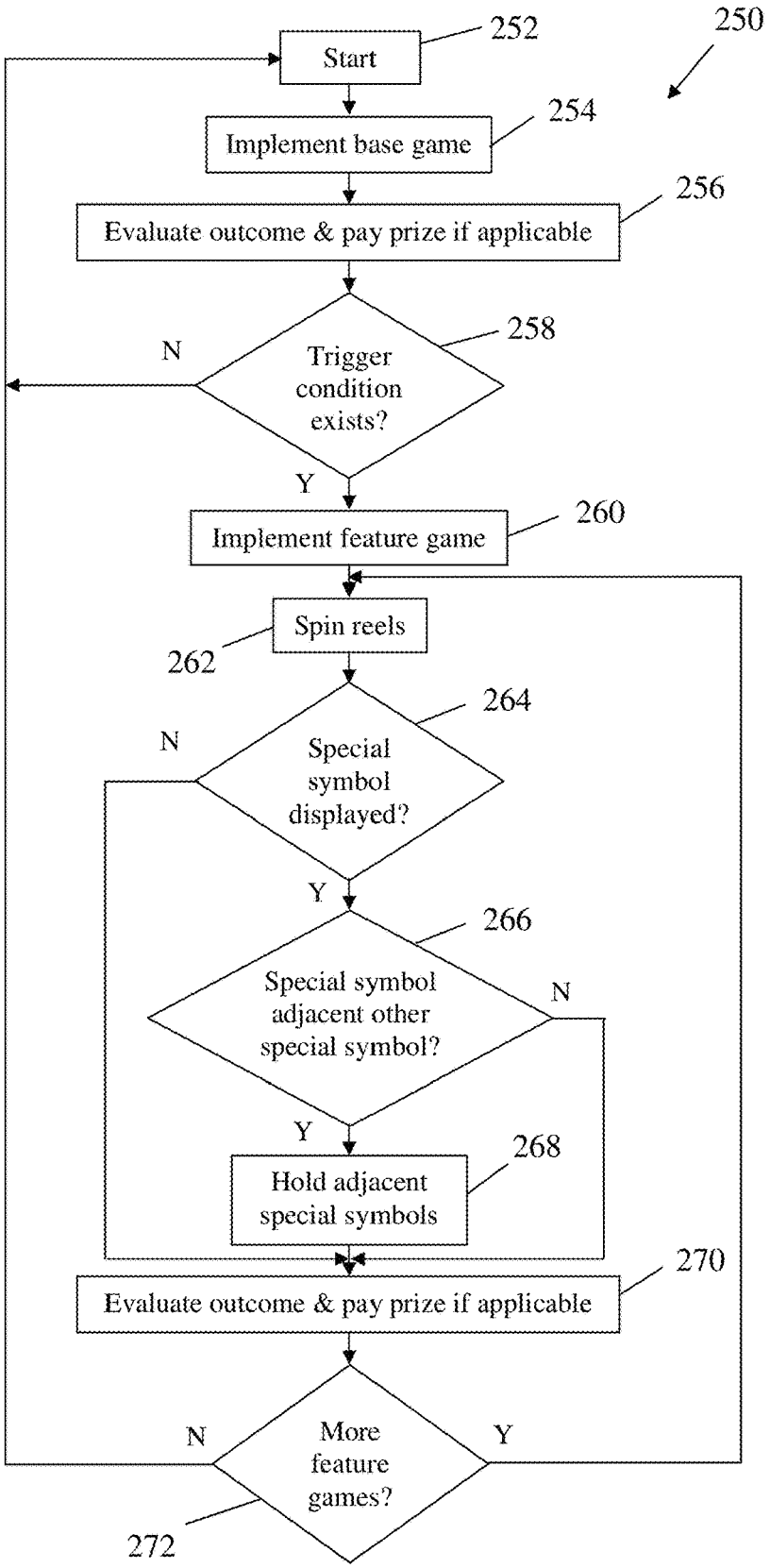
FIG. 7 is a flow diagram illustrating a method of gaming in accordance with an embodiment of the present invention.

Specific examples will now be described in relation to flow diagram 250 shown in FIG. 7 which illustrates steps 252 to 272 of a method of gaming implemented by the gaming system according to the present embodiment. In each of the examples, the gaming system 10, 44, 100 is operable in normal game mode and special game mode, although it will be understood that embodiments wherein only one game mode is provided are envisaged.

In a first example, five reels 304, 306, 308, 310, 312 are provided, with each reel having multiple symbols. The reels are virtual reels and, as such, representations of the reels are displayed in a display area 302 on a graphical display device 54.

During normal game mode, a base game is implemented 254 wherein the reels 304, 306, 308, 310, 312 are spun and subsequently stopped with three symbols displayed on each reel. The displayed symbols are then evaluated and a prize is awarded if applicable 256.

When a predetermined trigger condition occurs 258 during a base game, for example based on occurrence of a predetermined game outcome, by a player pressing a button after the player has identified that requirements for special game mode have been met, or in any other way, the gaming system 10, 44, 100 implements special game mode. Commencement of special game mode may be communicated to a player in any suitable way, for example by displaying an icon on the graphical display. In the present example, special game mode comprises two feature games.

Figure 8:
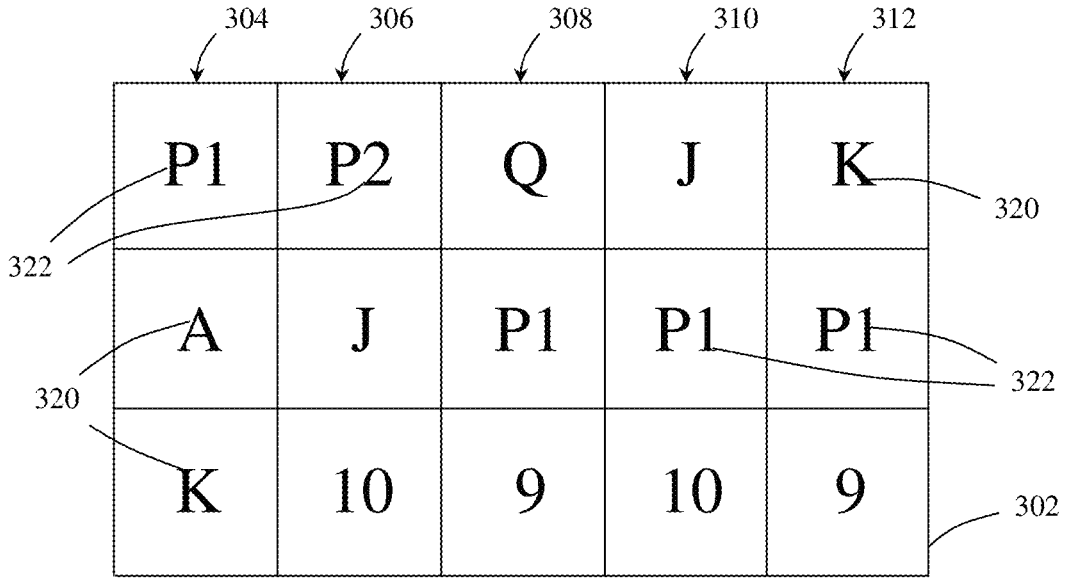
FIGS. 8 to 11 are diagrammatic representations of example displayed symbols of a gaming system in accordance with an embodiment of the present invention during use.

When special game mode commences, a first feature game is implemented 260 wherein the reels 304, 306, 308, 310, 312 are spun and subsequently stopped with three symbols displayed on each reel, as shown in FIG. 8. The symbols may be standard symbols 320 or special symbols 322.

In this example, picture symbols P1, P2 and P3 are defined as special symbols, although it will be understood that any of the available symbols may be defined as special symbols.

The displayed symbols are evaluated to determine whether a winning outcome exists. In the present example, since special symbol P1 pays only for five P1 symbols disposed along a defined win line, no winning outcome exists and no prize is awarded.

During the first feature game, any displayed special symbols 322 are identified by the special symbol determiner 26, and each identified special symbol 322 is evaluated to determine whether the special symbol 322 is disposed adjacent another similar special symbol 322. If two or more adjacently disposed similar special symbols 322 are displayed, the special symbols are held at the respective display positions for a subsequent feature game.

In the present example, a special symbol is considered to be adjacently disposed to another special symbol if the special symbol is disposed directly above, below or laterally of the other special symbol. However, it will be understood that other arrangements are possible. For example, in an embodiment a special symbol may be considered to be adjacent another special symbol if the special symbol is diagonally disposed relative to the other special symbol.

Figure 9:
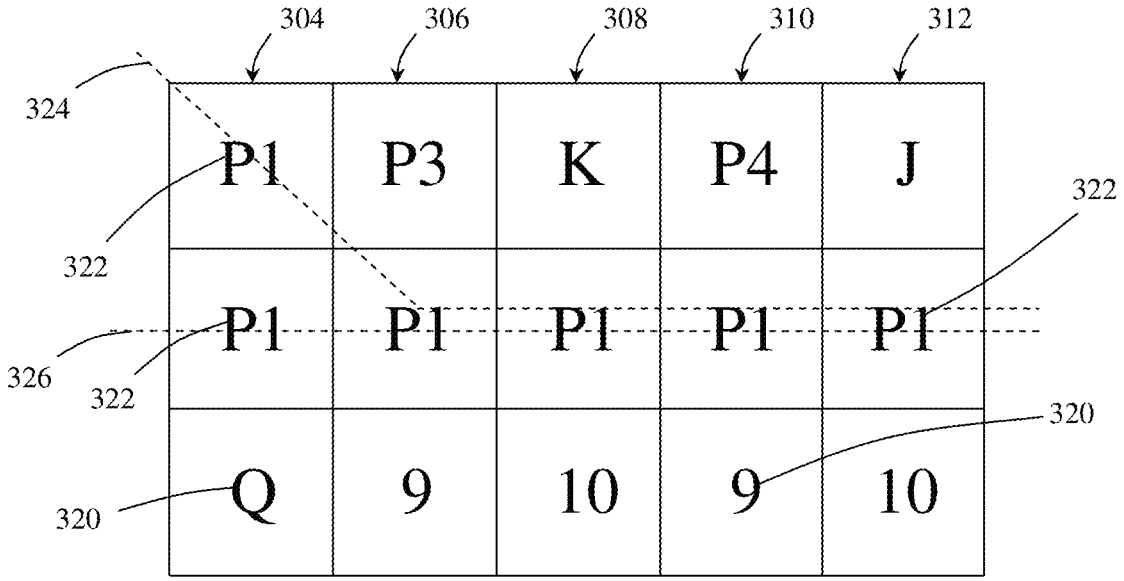

In a second feature game, the reels 304, 306, 308, 310, 312 are again spun and subsequently stopped while holding the special symbols that were disposed adjacent each other in the first feature game, as shown in FIG. 9.

The displayed symbols are then evaluated to determine whether a winning outcome exists. In the present example, five P1 symbols are disposed along a first defined win line 324 and five symbols are disposed along a second defined win line 326, so a prize for both win outcomes is awarded.

In a second example, a display area 340 is provided on a display with each display position 342 in the display area 340 being associated with a different reel so that each displayed symbol 320, 322 is independent of any other displayed symbol. With this arrangement, it will be understood that the likelihood that special symbols 322 will be displayed adjacent existing special symbols is increased compared with the first example shown in FIGS. 8 and 9 wherein each column corresponds to a single reel with a defined number of special symbols on each reel.

Figure 10:
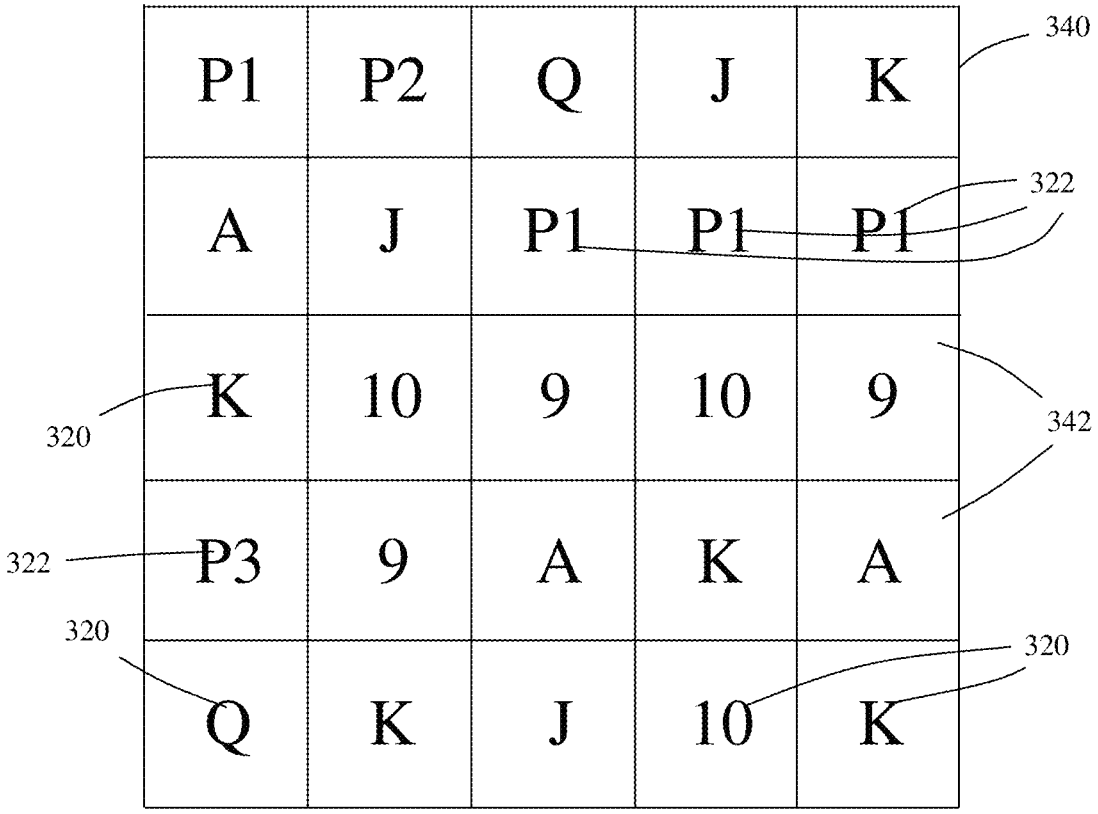

During a first feature game, the reels are spun and subsequently stopped with 25 symbols 320, 322 displayed in a 5×5 grid, as shown in FIG. 10. The displayed symbols are then evaluated and a prize is awarded if applicable 256. In the present example, since special symbol P1 pays only for five P1 symbols disposed along a defined win line, no winning outcome exists and no prize is awarded.

Any displayed special symbols 322 are then identified by the special symbol determiner 26 and each identified special symbol 322 is evaluated to determine whether the special symbol 322 is disposed adjacent another similar special symbol 322. If two or more adjacently disposed similar special symbols 322 are displayed, the special symbols 322 are held at the respective display positions for a subsequent feature game.

Figure 11:
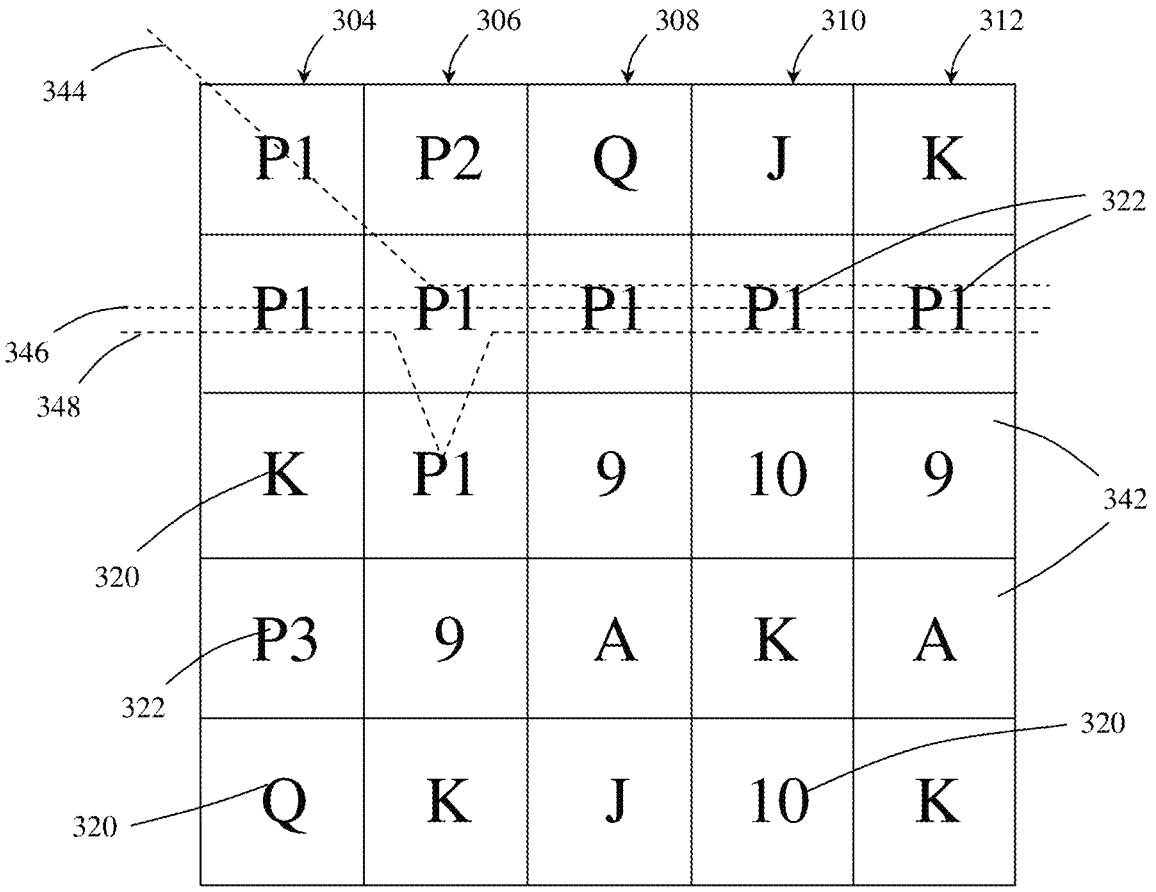

In a second feature game, the reels are again spun and subsequently stopped while holding the special symbols that were disposed adjacent each other in the first feature game, as shown in FIG. 11.

The displayed symbols are then evaluated to determine whether a winning outcome exists. In the present example, five P1 symbols are disposed along a first defined win line 344, five symbols are disposed along a second defined win line 346, and five symbols are disposed along a third defined win line 348. Accordingly, a prize for three win outcomes is awarded.

In an embodiment, if two or more different clusters of special symbol are displayed at the same time, the system may be arranged to make a determination as to whether to hold one or more of the special symbol clusters and, if so, which special symbol cluster to hold.

In a first example, the special symbols that form the largest or smallest cluster may be selected as the special symbols to be held for a subsequent game.

Alternatively, in a second example, the special symbol cluster that is to be held for a subsequent game may be selected randomly.

In a further example, the system may be arranged such that when a cluster of special symbols reaches a defined size, a prize is awarded if applicable, and the held symbols then released so that a new cluster of special symbols is allowed to develop in one or more subsequent feature games. For example, the defined size may be at least the size of a 3×3 square such that if a cluster of special symbols reaches at least the size of a 3×3 square, the system may be arranged to cease holding of the special symbols so that in a subsequent game any new cluster may develop.

Modifications and variations as would be apparent to a skilled addressee are deemed to be within the scope of the present invention.

What is claimed is:

1. A gaming machine comprising:

a graphical display device operable to display a plurality of display positions; and a game controller having at least one processor and a memory storing a set of symbols including a plurality of special symbols, and instructions, which, when executed, cause the at least one processor to at least:

control the graphical display device to display a plurality of symbols selected from the set of symbols at the plurality of display positions based on one or more random numbers generated by a random number generator, determine if the plurality of symbols selected include two or more different clusters of special symbols, identify one cluster of the two or more different clusters of special symbols determined to be retained for a subsequent selection of symbols, retain the one cluster of the two or more different clusters of special symbols identified at respective display positions on the graphical display device for the subsequent selection of symbols, and identify on the graphical display device a game outcome based on the plurality of symbols displayed including the two or more different clusters of special symbols.

2. The gaming machine of claim 1, wherein the instructions, when executed, further cause the at least one processor to determine amounts of special symbols in each of the two or more different clusters of special symbols determined to identify the one cluster of the two or more different clusters of special symbols determined to be held.

3. The gaming machine of claim 1, wherein the instructions, when executed, further cause the at least one processor to randomly determine the one cluster of the two or more different clusters of special symbols determined to be held.

4. The gaming machine of claim 1, wherein the instructions, when executed, further cause the at least one processor to select a larger cluster of special symbols of the two or more different clusters of special symbols determined to be held.

5. The gaming machine of claim 1, wherein the instructions, when executed, further cause the at least one processor to, when the one cluster reaches a defined size, release the one cluster so that no cluster of special symbols is held for the subsequent selection of symbols.

6. The gaming machine of claim 1, wherein the instructions, when executed, further cause the at least one processor to determine the game outcome in accordance with a plurality of defined win lines such that winning outcomes are determined to exist when defined symbols appear along the plurality of defined win lines.

7. The gaming machine of claim 6, wherein the instructions, when executed, further cause the at least one processor to determine the plurality of defined win lines based on all win lines that pass through a selected group of display positions, each group of display positions including a predefined plurality of display positions, and that meet win line criteria outside of the selected group of display positions.

8. A method of increasing an award from a game on a gaming machine, the gaming machine having a graphical display device operable to display a plurality of display positions, and a game controller having at least one processor and a memory storing a set of symbols including a plurality of special symbols, and instructions, which, when executed, cause the at least one processor to initiate the game, the method comprising:

displaying on the graphical display device a plurality of symbols selected from the set of symbols at the plurality of display positions based on one or more random numbers generated by a random number generator;

determining, via the at least one processor, if the plurality of symbols being selected include two or more different clusters of special symbols;

determining, via the at least one processor, one cluster of the two or more different clusters of special symbols to be retained for a subsequent selection of symbols;

displaying on the graphical display device the one cluster of the two or more different clusters of special symbols determined being retained at respective display positions for the subsequent selection of symbols; and determining, via the at least one processor, a game outcome based on the plurality of symbols displayed including the two or more different clusters of special symbols.

9. The method of claim 8, further comprising determining amounts of special symbols in each of the two or more different clusters of special symbols determined to identify the one cluster of the two or more different clusters of special symbols determined to be held.

10. The method of claim 8, further comprising randomly determining the one cluster of the two or more different clusters of special symbols determined to be held.

11. The method of claim 8, further comprising selecting a larger cluster of special symbols of the two or more different clusters of special symbols determined to be held.

12. The method of claim 8, further comprising, when the one cluster reaches a defined size, releasing the one cluster so that no cluster of special symbols is held for the subsequent selection of symbols.

13. The method of claim 8, further comprising determining the game outcome in accordance with defined win lines such that winning outcomes are determined to exist when defined symbols appear along the plurality of defined win lines.

14. A non-transitory computer-readable medium comprising i) a set of symbols including a plurality of special symbols, and ii) one or more sequences of instructions, for conducting a game on a gaming system including graphical display device operable to display a plurality of display positions, and a game controller, wherein the one or more sequences of instructions, which, when executed, cause the game controller to:

control the graphical display device to display a plurality of symbols selected from the set of symbols at the plurality of display positions based on one or more random numbers generated by a random number generator;

determine if the plurality of symbols selected include two or more different clusters of special symbols;

control the graphical display device to retain one cluster of the two or more different clusters of special symbols for a subsequent selection of symbols; and determine a game outcome based on the plurality of symbols displayed including the two or more different clusters of special symbols.

15. The non-transitory computer-readable medium of claim 14, wherein the one or more sequences of instructions, when executed, further cause the game controller to determine amounts of special symbols in each of the two or more different clusters of special symbols determined to identify the one cluster of the two or more different clusters of special symbols determined to be held.

16. The non-transitory computer-readable medium of claim 14, wherein the one or more sequences of instructions, when executed, further cause the game controller to randomly determine the one cluster of the two or more different clusters of special symbols determined to be held.

17. The non-transitory computer-readable medium of claim 14, wherein the one or more sequences of instructions, when executed, further cause the game controller to select a larger cluster of special symbols of the two or more different clusters of special symbols determined to be held.

18. The non-transitory computer-readable medium of claim 14, wherein the one or more sequences of instructions, when executed, further cause the game controller to, when the one cluster reaches a defined size, release the one cluster so that no cluster of special symbols is held for the subsequent selection of symbols.

19. The non-transitory computer-readable medium of claim 14, wherein the one or more sequences of instructions, when executed, further cause the game controller to determine the game outcome in accordance with a plurality of defined win lines such that winning outcomes are determined to exist when defined symbols appear along the plurality of defined win lines.

20. The non-transitory computer-readable medium of claim 19, wherein the one or more sequences of instructions, when executed, further cause the game controller to determine the plurality of defined win lines based on all win lines that pass through a selected group of display positions, each group of display positions including a predefined plurality of display positions, and that meet win line criteria outside of the selected group of display positions.

* * * * *